US006810588B1

(12) United States Patent
Cheng

(10) Patent No.: US 6,810,588 B1
(45) Date of Patent: Nov. 2, 2004

(54) FOLDING KNIFE STRUCTURE

(75) Inventor: Yang-Fu Cheng, Taipei (TW)

(73) Assignee: Kantas Products Co., Ltd., Taipei (TW)

( * ) Notice: Subject to any disclaimer, the term of this patent is extended or adjusted under 35 U.S.C. 154(b) by 0 days.

(21) Appl. No.: 10/610,550

(22) Filed: Jul. 2, 2003

(51) Int. Cl.[7] ..... B26B 1/02
(52) U.S. Cl. ..... 30/153; 30/160
(58) Field of Search ..... 30/153, 160, 151, 30/2; 7/118–120

(56) References Cited

U.S. PATENT DOCUMENTS 1,810,031 A * 6/1931 Schrade ..... 30/159
2,197,136 A * 4/1940 Wallace et al. ..... 30/159
5,815,927 A * 10/1998 Collins ..... 30/161
6,308,420 B1 * 10/2001 Moser ..... 30/161

* cited by examiner

*Primary Examiner*—Douglas D Watts
(74) *Attorney, Agent, or Firm*—Bacon & Thomas PLLC

(57) ABSTRACT

The present invention discloses a folding knife that can be unfolded quickly, and its technology mainly resides on installing an elastic bar in a handle of the knife, and such elastic bar matches exactly with a groove hole on the blade body, so that during the process of rotating the blade body, the blade body can be rotated out from an open slot on one side of the handle quickly by the joint mechanism of the elastic bar and the groove hole.

10 Claims, 8 Drawing Sheets

FOLDING KNIFE STRUCTURE

BACKGROUND OF THE INVENTION

1. Field of the Invention

The present invention relates to a folding knife structure, more particularly to a folding knife structure that can be easily unfold with one hand.

2. Description of the Related Art

In general, a folding knife mainly comprises a handle and a blade body, wherein one end of the blade body is a pivotal connecting end, and such pivotal connecting end is pivotally coupled to one end of the handle, so that the blade body can be stored into an open slot disposed on one side of the handle. When a user wants to use the knife, the user has to hold the handle with one hand and use both of the index finger and the thumb of another hand to pull the blade body out from the open slot of the handle. However, the use of such folding knife requires both hands to take the blade body out from the handle. For special situations, if the user only can use one hand for the use, then such folding knife cannot be used. For example, if a user's hand is tangled by a rope or a net and tries to rescue himself/herself by cutting the rope or the net immediately, or if one of the user's hands is injured and leaves the user one hand to use the knife, then the user will fall into an embarrassing situation of not able to use such folding knife.

Manufacturers aim at the above shortcomings to develop a spring knife as shown in FIG. 1. Such spring knife 2 comprises a hollow handle 20, an opening disposed on one side of the handle 20, a blade body 21 disposed in the handle 20, a blade section 211 disposed on an appropriate position of one side of the blade body 21, and a pivotal connecting section 212 at one end of the handle 20 for pivotally coupling to an axial rod 22 disposed at one end of the handle 20, an elastic member 23 coupled to the blade body 21 and disposed in the handle 20, and a press switch 24 disposed in the handle 20 proximate another side of the blade body 21 and adjacent to a position proximate the axial rod 22, so that when the user presses the press switch 24, the blade body 21 is released from the latch and the elasticity of the elastic member 23 drives the blade body 21 to rotate along the axis of the axial rod 22 and rotate the blade body 21 out from the handle 20. In other words, a user only needs one hand to operate the spring knife 2 easily and quickly.

However, the press switch 24 protrudes from an obvious exposed position on the surface of the handle 20. Under situations of negligence or the knife being played by a child, the blade body 21 may be opened by touching the press switch 24. As a result, it may cause accidents or injuries, which turns the original intention of the design into a danger.

In view of the inconvenience on the use of traditional folding knives, an improved spring knife was introduced. Although the spring knife can overcome the inconvenience of the traditional folding knife, the blade body of the spring knife may spring out from the handle and hurt innocent people by touching the press switch by mistake. Therefore, the inventor of the present invention performed a series of studies and experiments to overcome the shortcomings of the prior art and finally invented the folding knife structure of the present invention.

SUMMARY OF THE INVENTION

The primary objective of the present invention is to provide a folding knife that can be unfolded quickly, and its technology mainly resides on installing an elastic bar in a handle, and such elastic bar can exactly match with a groove hole on the blade body, so that the blade body can be rotated out from an open slot on one side of the handle quickly by the joint mechanism of the elastic bar and the groove hole during the process of rotating the blade body.

Another objective of the present invention is to provide a folding knife that can be unfolded by one hand. In addition to the structure described above, a poke rod is installed each on both sides of the blade body such that when a user uses one hand to hold the handle and uses the index finger or the thumb to push the poke rod, the blade body will spring out from the open slot of the handle quickly.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
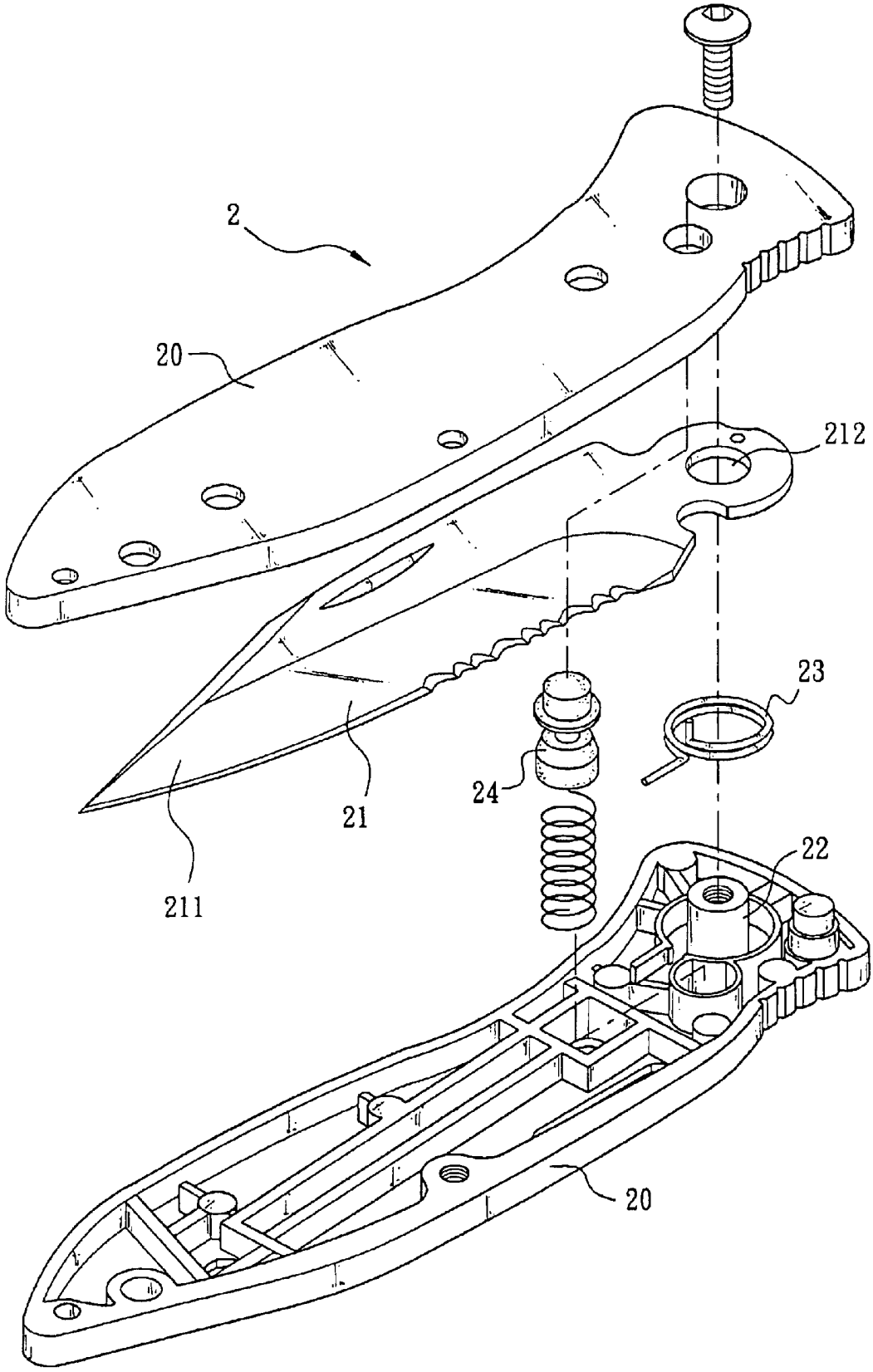
FIG. 1 (Prior Art)
FIG. 1 is a perspective diagram of the disassembled parts of a traditional spring knife.
Figure 2:
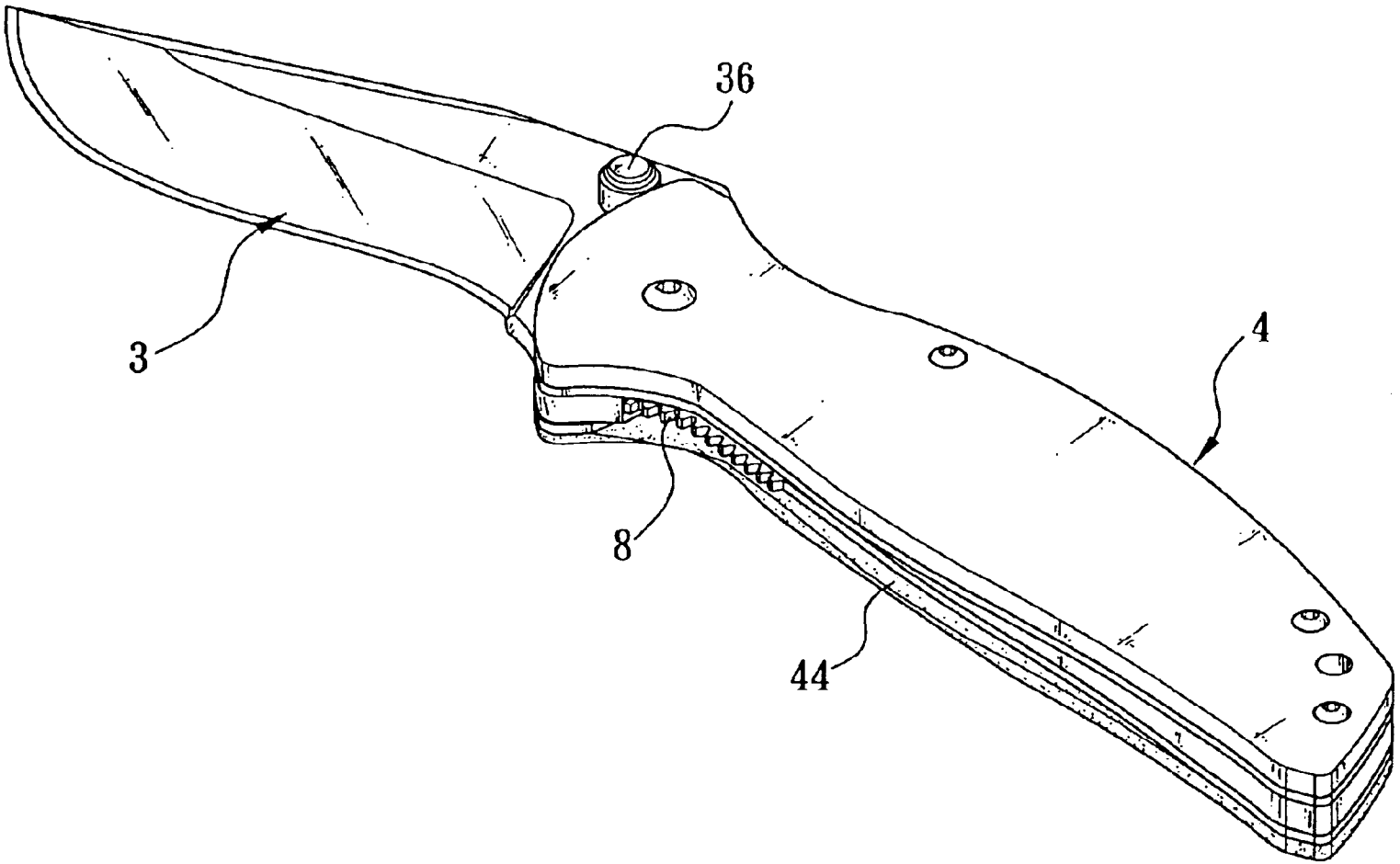
FIG. 2 is a perspective diagram of the assembled structure of the present invention.
Figure 3:
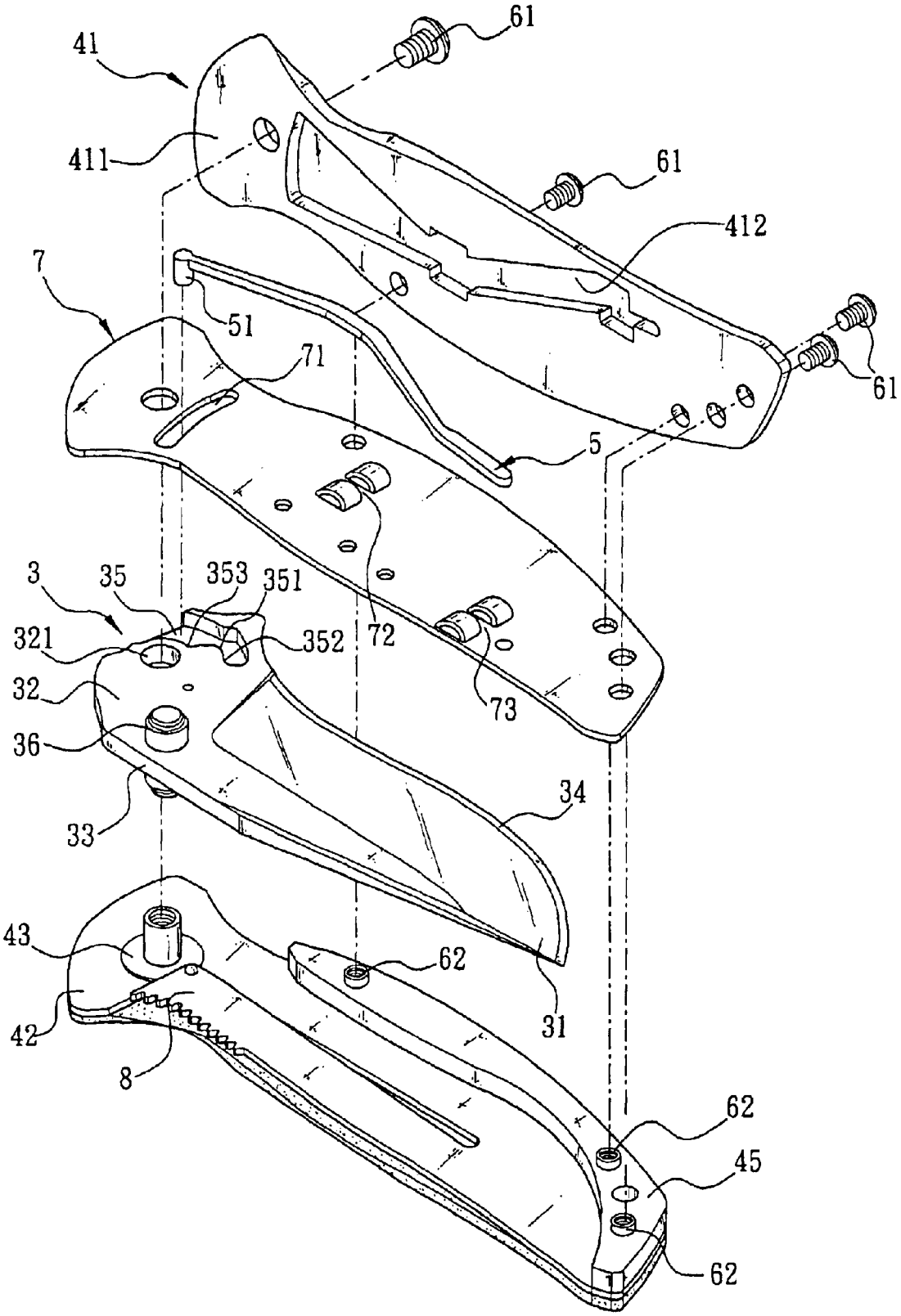
FIG. 3 is a perspective diagram of the disassembled parts of the present invention.

Refer to FIGS. 2 and 3 for a folding knife structure according to the present invention, which comprises a blade body 3, having a blade tip 31 and a blade handle 32 on both ends, a blade back 33 and a blade 34 respectively on both corresponding sides, wherein the blade handle 32 has a pivotal connecting end 321 (such as a circular hole), and the pivotal connecting end 321 is pivotally coupled to a pivotal connecting element 43 (such as an axial pillar) disposed on one end of the knife handle 4 such that the blade body 3 is received into or sprung out from an open slot 44 disposed on one side of the knife handle 4. Further, a groove hole 35 is disposed on the blade body 3 at a position adjacent to the blade 34 along the pivotal connecting end 321, and a separating point 351 is protruded from one inner edge of the groove hole 35 proximate the pivotal connecting end 321, and a first pressing section 352 is disposed on one side of the separating point 351 adjacent to the blade 34 and a second pressing section 353 is disposed on the side away from the blade 34. An elastic bar 5 is disposed on the inner surface 411 of the adjacent knife handle 4, and one end of the elastic bar 5 is extended and bent into a bending section 51 in the groove hole 35.

Please refer to FIGS. 2 and 3 for the present invention. When the elastic bar 5 is not deformed, both ends of the elastic bar 5 are bent towards the middle, and both ends are closer to the open slot 44 than the middle. When the blade body 3 is folded into the open slot 44, the elastic bar 5 will produce a larger deformation (changing from the status of having larger curvature to the status of a smaller curvature) and provides better elasticity for the restoration.

Figure 4A:
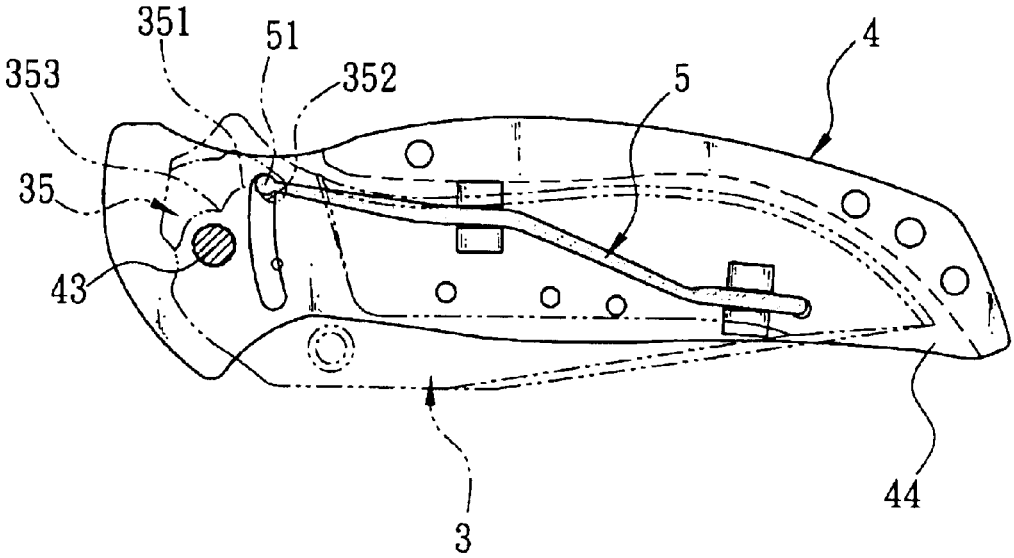
FIG. 4A is the first illustrative diagram of the movement of the present invention.
Figure 4B:
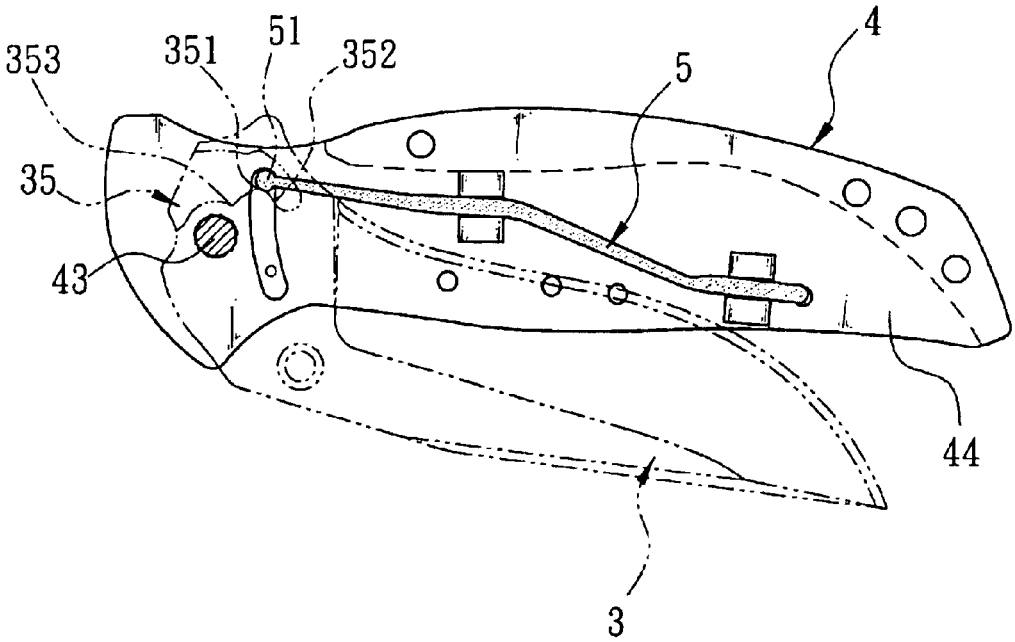
FIG. 4B is the second illustrative diagram of the movement of the present invention.
Figure 4C:
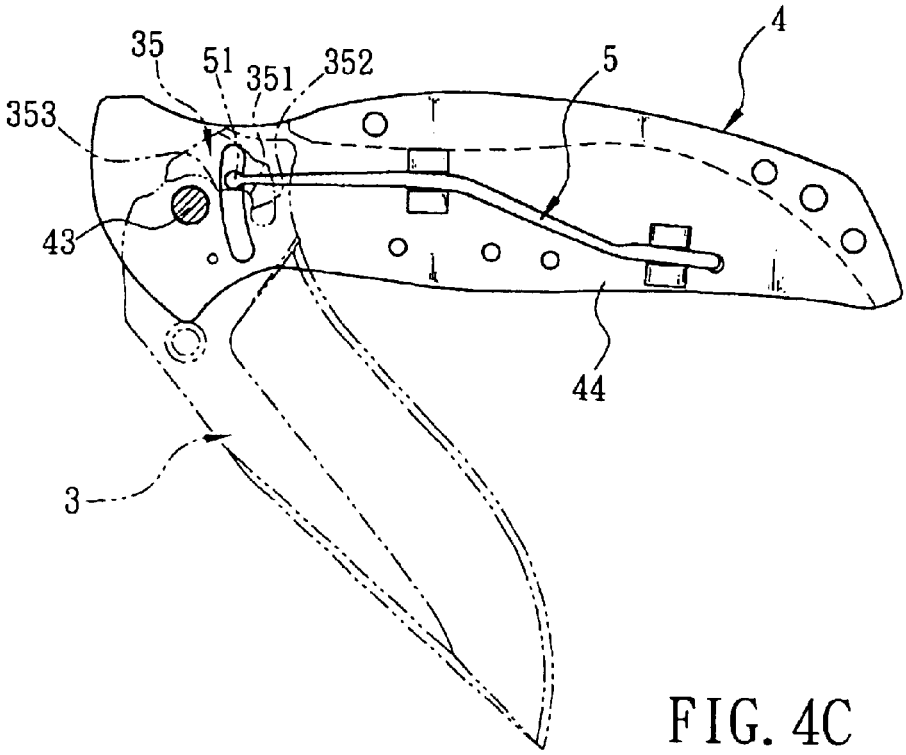
FIG. 4C is the third illustrative diagram of the movement of the present invention.
Figure 4D:
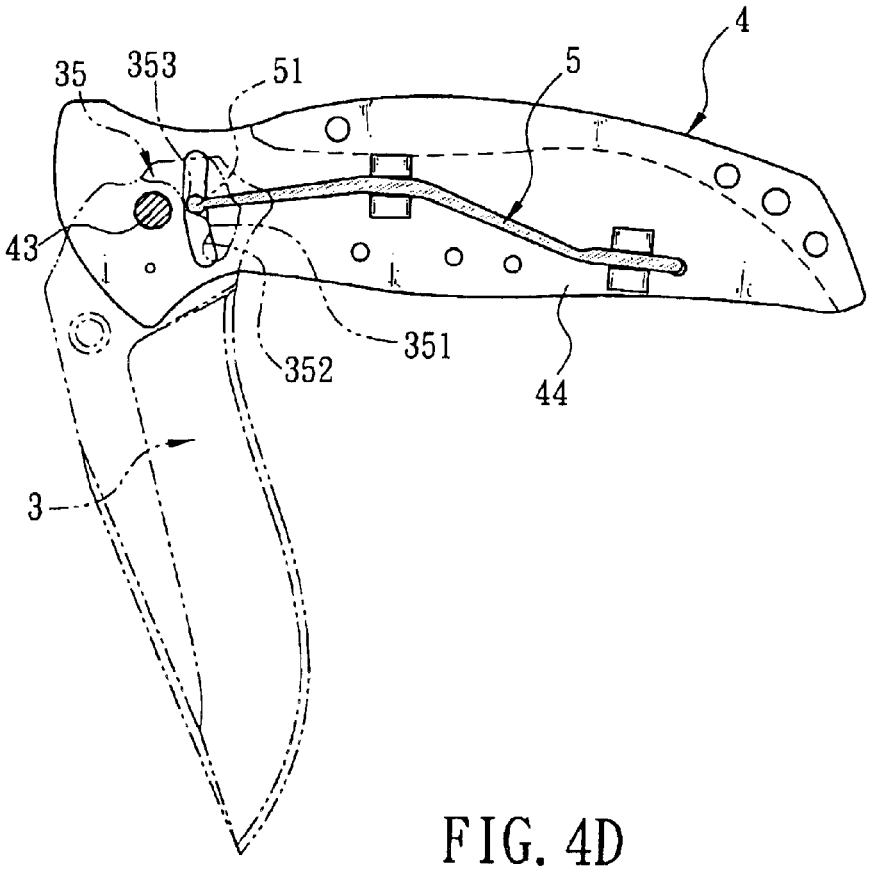
FIG. 4D is the fourth illustrative diagram of the movement of the present invention.
Figure 4E:
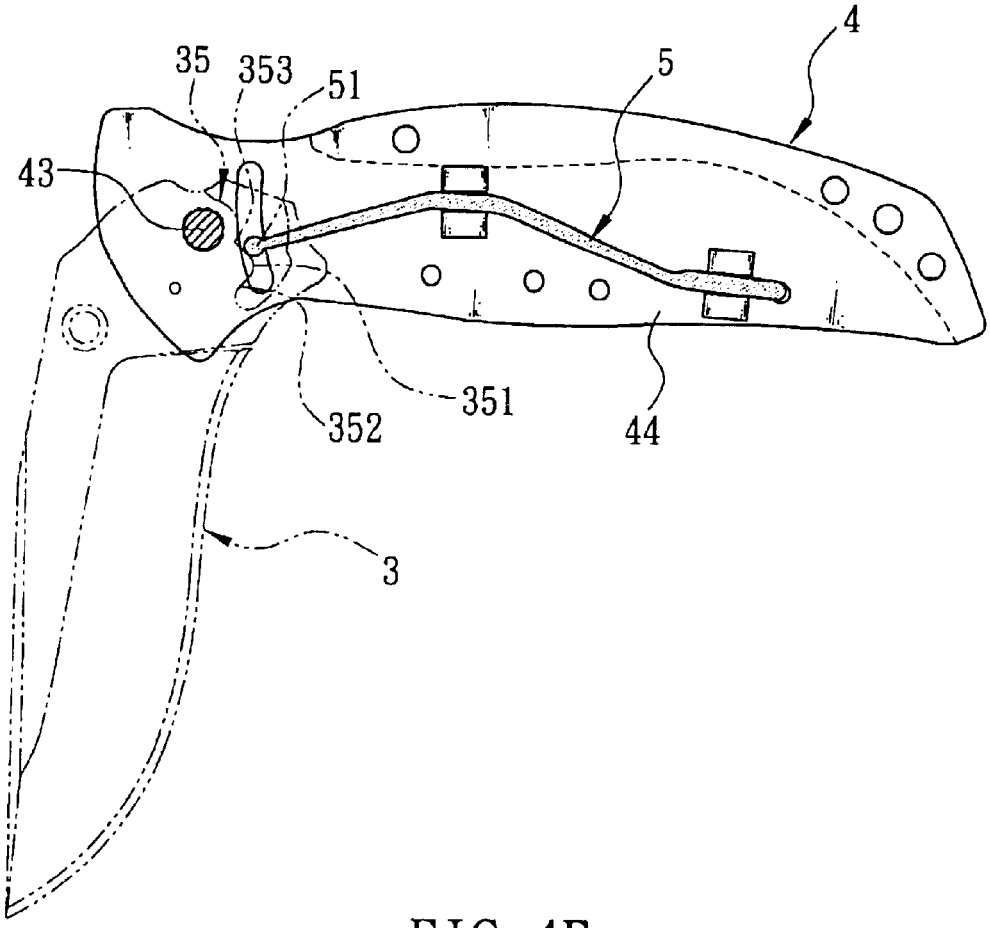
FIG. 4E is a fifth illustrative diagram of the movement of the present invention.
Figure 4F:
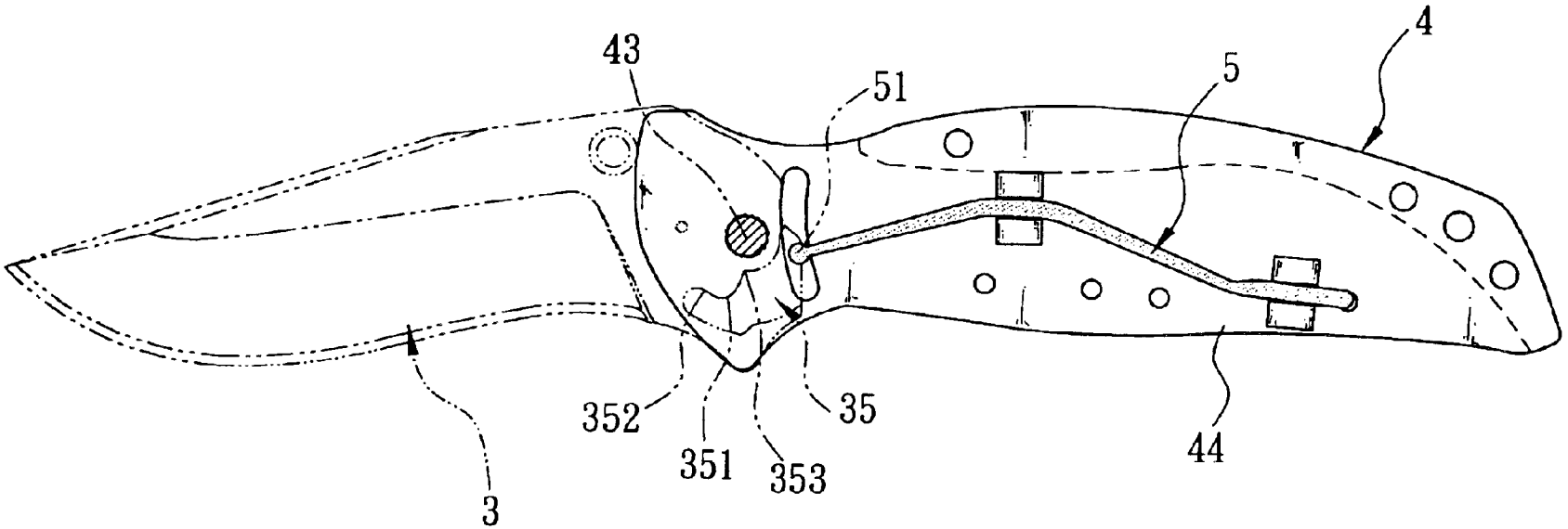
FIG. 4F is the sixth illustrative diagram of the movement of the present invention.

Please refer to FIGS. 4A~4F for the illustrative diagrams of the movement. When the blade body 3 is stored into the open slot 44, the first pressing section 352 exactly pushes the bending section 51, so that the elastic bar 5 will deform and maintain an appropriate elastic restoration (as shown in FIG. 4A). At that time, if the blade body 3 uses such pivotal connecting element 43 as an axis to apply an appropriate external force in the direction away from the knife handle 4, since the groove hole 35 is set on the blade body 3, therefore the groove hole 35 will start shifting along the pivotal connecting element 43 as shown in FIG. 4B, such that the separating point 351 will slide through the bending section 51 (that is the appropriate external force can release the mutual pressing situation between the first pressing section 352 and the bending section 51) until the bending section 51 and the second pressing section 353 are in contact with each other as shown in FIG. 4C. The elastic bar 5 starts pushing the second pressing section 353 (as shown in FIGS. 4D and 4E) by the elastic restoration force produced by the deformation, so that the blade body 3 can use the pivotal connecting element 43 as an axis to start moving away from the open slot 44 and rotating out from the knife handle 4 (as shown in FIGS. 2 and 4F).

On the other hand, when the knife body 3 is completely extended out from the knife handle 4 (as shown in FIGS. 2 and 4F), if the knife body 3 uses the pivotal element 43 as an axis to exert an appropriate external force at a position proximate the open slot 44, the groove hole 35 will shift along the pivotal connecting end 321 as shown in FIGS. 3, 4D and 4E) to drive the second pressing section 353 to push the ending section 51, so that the elastic bar 5 start generating a deformation (as shown in FIG. 4C). When the separating point 351 slides through the bending section 51, the bending section 51 and the first pressing section 352 are in contact with each other (as shown in FIG. 4B). Then, the elastic bar 5 starts pushing the first pressing section 352 by the appropriate elastic restoration force of the elastic bar 5, so that the blade body 3 can use the pivotal connecting element 43 as an axis to start moving towards the open slot 44 until the blade body 3 is completely stored into the open slot 44 (as shown in FIG. 4A).

Please refer to FIGS. 2 and 3 for the present invention. The knife handle 4 comprises a casing 41, another casing 42, and a back cover 45 coupled to each other by a plurality of connecting elements 61 and another connecting elements 62 (such as a bolt and a nut), wherein the back cover 45 is installed on a corresponding side between the casings 41, 42. Since the back cover 45 has a specific thickness (slightly thicker than the blade body 3) so that the casings 41, 42 are kept in an appropriate distance apart to define the open slot 44.

Please refer to FIG. 3 for the present invention. The inner surface 411 of the casing 41 has an accommodating groove 412 for installing the elastic bar 5 into the accommodating groove 412. A fixed plate 7 is fixed onto the inner surface 411; a curved hole 71 is disposed on one end adjacent to the pivotal connecting end 321; a limit section 72 is disposed at a position adjacent to the curved hole 71; and another limit section 73 is disposed at a position away from the curved hole 71, so that when the fixed plate 7 is covered onto the inner surface 411, the elastic bar 5 will be fixed into the accommodating groove 412 and limited by the limit sections 72, 73 to serve as a fulcrum for the deformation. Further, the bending section 51 is exposed outside the fixed plate 7 from the curved hole 71, such that the bending section 51 will be located in the groove hole 35 after the casing 41, another casing 42, and the blade body 3 are mutually coupled as a whole.

Please refer to FIGS. 2 and 3 again for the present invention. In the open slot 44, a stop element 8 is disposed at a position adjacent to another casing 42, and the stop element 8 is elastically bent slightly toward the middle of the open slot 44, so that after the blade body 3 is rotated completed out from the open slot 44, the stop element 8 will press exactly on one side of the blade handle 32 to stop the blade body 3 from being rotated into the open slot 44. On the contrary, after the blade body 3 is received into the open slot 44, an appropriate external force is applied on the stop element 8 in a direction towards another casing 42 (i.e. releasing the mutual pressing situation between the stop element 8 and the blade handle 32), an appropriate external force will be applied onto the blade body 3 in the direction towards the open slot 44 to store the blade body 3 into the open slot 44.

Please refer to FIGS. 2 and 3 for the present invention. Based on the concept of ergonomic design, a poke rod 36 is set respectively on a position on one surface of the blade body 3 and a position adjacent to the blade back 33. By such design, when the blade body 3 is stored in the open slot 44, the user only needs to hold the knife handle 4 with the palm and use the thumb to push the poke rod 36, and then an appropriate external force in the direction away from the knife handle 4 will be exerted onto the blade body 3 such that the blade body 3 will quickly move away from the open slot 44 and extend outside the knife handle 4 until the poke rod 36 and the knife handle 4 are in contact with each other. At that time, if the stop action of the stop element 8 is put into effect, then the blade body 3 is secured onto one end of the knife handle 4. On the contrary, when the blade body 3 is stored into the open slot 44, since the poke rods 36 exactly press against the stop element 8, the blade 34 will not be in direct contact with the back cover 45 in the process of storing the blade body 3 into the open slot 44, therefore it can prevent the back cover 45 from being cut and damaged by the blade 34, an thus can maintain the sharpness of the blade 34.

Figure 5:
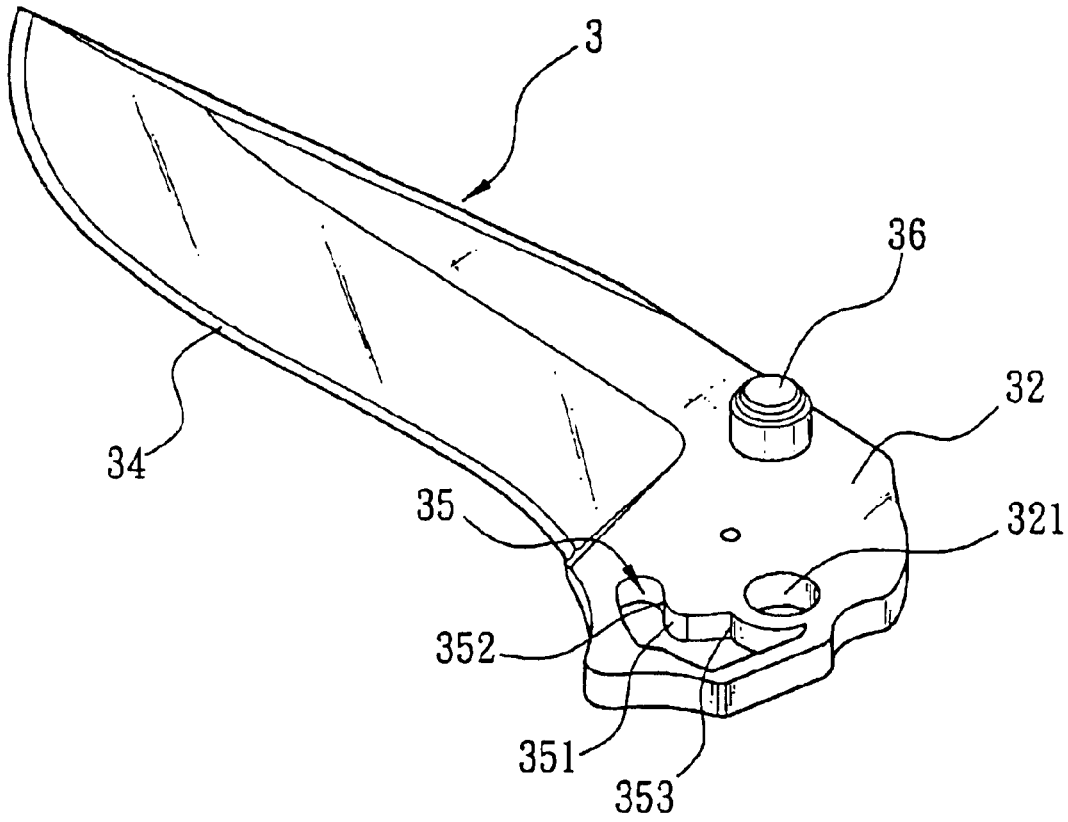
FIG. 5 is a perspective diagram of a preferred embodiment of the present invention.

Please refer to FIGS. 2 and 5. There are various modifications for setting the groove boles 35 on the blade body 3, as long as the groove hole 35 has a separating point 351 protruded on an inner edge of a pivotal connecting end 321 adjacent to the groove hole 35 and two sides of the separating point 351 are disposed respectively on the first pressing section 352 and the second pressing section 353. For example, a substantially half-moon shaped through hole (as shown in FIG. 5) is passed through by the blade body 3 or a indented groove (as shown in FIG. 2) is set on the one end of the blade body 3 towards the inner edge of the pivotal connecting end 321. Therefore, any variation or modification that can easily be made by the person skilled in the art is included within the scope of the claims of this invention.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. A folding knife structure, comprising:

a blade body, having a blade tip and a blade handle respectively disposed on both ends of said blade body and a blade back and a blade respectively disposed on the sides corresponding to both sides, wherein said blade handle comprising a pivotal connecting end, and a groove hole along the pivotal connecting end and being disposed on said blade body at a position adjacent to said blade, a separating point protruded from said groove hole at an inner edge adjacent to said pivotal connecting end, a first pressing section disposed on one side adjacent to said blade and a second pressing section disposed on the other side away from said blade;

a knife handle, having a pivotal connecting element at one end for mutually coupling with the pivotal connecting end, thereby said blade body using said pivotal connecting element as an axis to be stored into and rotated out from an open slot disposed on one side of said knife handle;

an elastic bar, being disposed on the inner surface of the adjacent knife handle, and one end of the elastic bar is extended and bent into a bending section in the groove hole.

2. The folding knife structure of claim 1, wherein said groove hole is an indented groove evacuated in the direction from said blade handle towards said blade.

3. The folding knife structure of claim 1, wherein said groove hole is a through hole being passed through by said blade handle.

4. The folding knife structure of claim 1, wherein said elastic bar has both ends bending towards its middle, and both ends being closer to said open slot than its middle when said elastic bar not being deformed.

5. The folding knife structure of claim 1, wherein said knife handle is comprised of a casing, another casing, and a back cover, being mutually coupled by a plurality of connecting elements and another connecting elements, and said back cover being installed on one of the corresponding side between said casings.

6. The folding knife structure of claim 1, wherein said casing has an accommodating groove on the inner surface of said casing for installing said elastic bar.

7. The folding knife structure of claim 6, wherein said inner surface has a fixed plate thereon.

8. The folding knife structure of claim 7, wherein said fixed plate has a curved hole disposed on one side adjacent to said pivotal connecting end, a limit section disposed at a position adjacent to said curved hole, and another limit section disposed at a position away from said curved hole, such that when the fixed plate being covered onto the inner surface, the elastic bar being fixed into said accommodating groove and limited by the limit sections, and said bending section being substantially exposed outside said fixed plate.

9. The folding knife structure of claim 1, wherein said open slot has a stop element elastically bent slightly towards the middle of said open slot.

10. The folding knife structure of claim 1, wherein said blade body has a poke rod on one side at a position adjacent to said blade back.

* * * * *